US009581349B2

(12) United States Patent
Jo et al.

(10) Patent No.: US 9,581,349 B2
(45) Date of Patent: Feb. 28, 2017

(54) INDOOR UNIT AND AIR CONDITIONING SYSTEM USING THE SAME

(71) Applicant: SAMSUNG ELECTRONICS CO., LTD., Suwon-si, Gyeonggi-do (KR)

(72) Inventors: Su Ho Jo, Seongnam-si (KR); Kwan Joo Myoung, Suwon-si (KR); Awata Hiroshi, Seongnam-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 608 days.

(21) Appl. No.: 14/162,978

(22) Filed: Jan. 24, 2014

(65) Prior Publication Data

US 2014/0346238 A1 Nov. 27, 2014

(30) Foreign Application Priority Data

May 22, 2013 (KR) ..... 10-2013-0057840

(51) Int. Cl.
*F24F 11/00* (2006.01)

(52) U.S. Cl.
CPC ... *F24F 11/0009* (2013.01); *F24F 2011/0067* (2013.01); *F24F 2011/0072* (2013.01)

(58) Field of Classification Search
CPC ..... F24F 11/0009; F24F 2011/0067; F24F 2011/0068; F24F 2011/0072
USPC ..... 236/51
See application file for complete search history.

(56) References Cited

U.S. PATENT DOCUMENTS 4,526,010 A * 7/1985 Sato ..... F24F 11/0009 340/870.39
4,764,981 A * 8/1988 Miyahara ..... G08C 25/02 340/12.22
5,555,509 A * 9/1996 Dolan ..... F24F 1/00 236/51
5,751,948 A * 5/1998 Dolan ..... H04L 29/06 714/52

* cited by examiner

*Primary Examiner* — Marc Norman
(74) *Attorney, Agent, or Firm* — Staas & Halsey LLP

(57) ABSTRACT

An indoor unit and an air conditioning system using the same include a first communication module to communicate with a wired remote controller, a power switch connected to a power terminal of one or the other side of the first communication module, a ground switch connected to a ground terminal of one or the other side of the first communication module to constitute a pair with the power switch, and an indoor unit controller to turn on the power switch and the ground switch when an indoor unit supplies power to the wired remote controller, and to turn off the power switch and the ground switch when another indoor unit supplies power to the wired remote controller.

20 Claims, 5 Drawing Sheets

INDOOR UNIT AND AIR CONDITIONING SYSTEM USING THE SAME

CROSS-REFERENCE TO RELATED APPLICATIONS

This application claims the benefit of Korean Patent Application No. 10-2013-0057840, filed on May 22, 2013 in the Korean Intellectual Property Office, the disclosure of which is incorporated herein by reference.

BACKGROUND

1. Field

One or more embodiments relate to an indoor unit and an air conditioning system using the same.

2. Description of the Related Art

A general air conditioner is a device for heating or cooling an indoor space, which circulates a refrigerant between an indoor unit and an outdoor unit to perform a cooling or heating function based on characteristics whereby a refrigerant in a liquid state absorbs surrounding heat when vaporized and emits the heat when liquefied.

In general, with regard to a typical air conditioner, one indoor unit is installed with respect to one outdoor unit. Recently, consumer demand for a system air conditioner, in which various indoor units with various shapes and capacities are connected to one or more outdoor units to perform a cooling or heating function in a place containing a plurality of separate spaces, such as in a school, a company, or a hospital, has increased.

The system air conditioner includes, for example, one outdoor unit and a plurality of indoor units and is configured in such a way that a direct current (DC) power line, a communication line, etc. are connected between the outdoor unit and each indoor unit such that the outdoor unit and each indoor unit communicate with each other.

SUMMARY

Therefore, the foregoing described aspects and/or other aspects may be achieved by one or more embodiments of an indoor unit and an air conditioning system using the same, for preventing a malfunction of a communication circuit regardless of polarities connected between devices.

Additional aspects and/or advantages of one or more embodiments will be set forth in part in the description which follows and, in part, will be apparent from the description, or may be learned by practice of one or more embodiments of disclosure. One or more embodiments are inclusive of such additional aspects.

In accordance with one or more embodiments, an indoor unit may include a first communication module to communicate with a wired remote controller, a power switch connected to a power terminal of one or the other side of the first communication module, a ground switch connected to a ground terminal of one or the other side of the first communication module to constitute a pair with the power switch, and an indoor unit controller to turn on the power switch and the ground switch when an indoor unit supplies power to the wired remote controller, and to turn off the power switch and the ground switch when another indoor unit supplies power to the wired remote controller.

The wired remote controller and the indoor unit may communicate with each other in a straight polarity manner of connecting the wired remote controller and the indoor unit to the same polarity, a reverse polarity manner of connecting the wired remote controller and the indoor unit to different polarities, or a mixture thereof.

The power switch and the ground switch may each include a relay or a transistor.

The wired remote controller and the first communication module may be connected to each other using DC power two-wire communication to transmit a communication signal and power via two lines.

In accordance with one or more embodiments, an air conditioning system may include an outdoor unit, a wired remote controller to receive power from an indoor unit and to operate, and a plurality of indoor units connected to the outdoor unit, wherein a group of a power switch and ground switch of a corresponding specific indoor unit may be turned on and a group of a power switch and ground switch of another indoor unit may be turned off when the corresponding specific indoor unit supplies power to the wired remote controller.

The indoor unit may include a first communication module to communicate with a wired remote controller, a power switch connected to a power terminal of one or the other side of the first communication module, a ground switch connected to a ground terminal of one or the other side of the first communication module to constitute a pair with the power switch, and an indoor unit controller to turn on the power switch and the ground switch when an indoor unit supplies power to the wired remote controller, and to turn off the power switch and the ground switch when another indoor unit supplies power to the wired remote controller.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
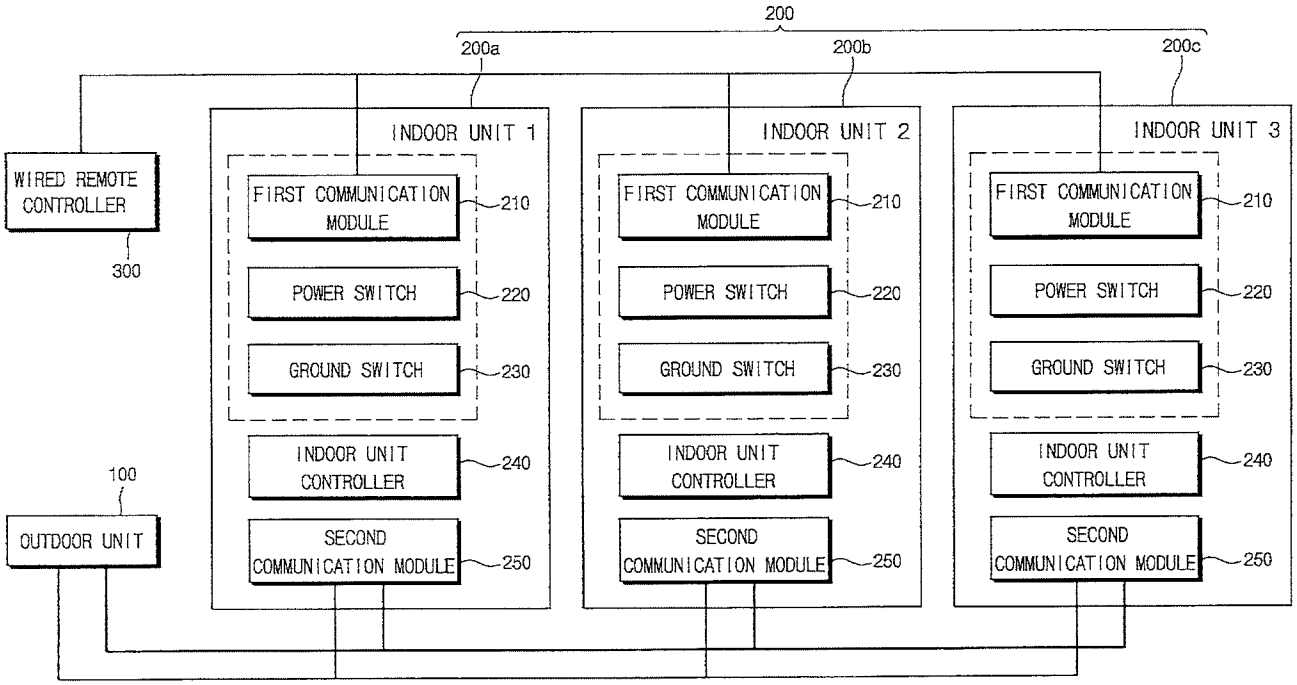
FIG. 1 is a diagram illustrating a configuration of an air conditioning system according to one or more embodiments.

Reference will now be made in detail to one or more embodiments, illustrated in the accompanying drawings, wherein like reference numerals refer to like elements throughout. In this regard, embodiments of the present invention may be embodied in many different forms and should not be construed as being limited to embodiments set forth herein, as various changes, modifications, and equivalents of the systems, apparatuses and/or methods described herein will be understood to be included in the invention by those of ordinary skill in the art after embodiments discussed herein are understood. Accordingly, embodiments are merely described below, by referring to the figures, to explain aspects of the present invention.

Hereinafter, a disclosed air conditioning system may refer to a system air-conditioner.

Reference will now be made in detail to the embodiments of the present invention, examples of which are illustrated in the accompanying drawings.

FIG. 1 is a diagram illustrating a configuration of an air conditioning system according to one or more embodiments.

As illustrated in FIG. 1, the air conditioning system may include an outdoor unit 100, indoor units 200, and a wired remote controller 300.

In this case, the outdoor unit 100 and the indoor units 200 may be connected to each other to communicate with each other such as, for example, via RS485 two-wire communication. RS 485 as an expansion version of RS232 and RS422 is a kind of a serial communication protocol standard specification for supporting a home network. In order to supplement RS232 with a relatively low transmission rate and a short transmission distance, RS422 may be employed. According to RS422, data may be transmitted between one master device and one slave device. On the other hand, according to RS485, data may be transmitted between all devices through the same line and support both a semi-duplex communication method and a duplex communication method. In addition, according to RS485, it may be possible that a maximum of 32 drivers and a maximum 32 receivers may be used and a network with a maximum speed of 10 Mbps and a maximum distance of 1.2 km may be established.

Although not illustrated, the outdoor unit 100 may include a compressor to compress a refrigerant, a four-way valve to adjust a direction of a flow of the refrigerant ejected from the compressor, an outdoor heat exchanger to receive the refrigerant compressed by the compressor and to exchange heat with outside air, an outdoor fan to send air to the outdoor heat exchanger, an outdoor fan motor to rotate the outdoor fan, an electronic expansion valve to expand the refrigerant sent from the outdoor heat exchanger and to simultaneously adjust a flow of the refrigerant ejected from the outdoor heat exchanger, and an accumulator to transmit the refrigerant discharged from indoor and outdoor heat exchangers to the compressor in the form of gas and may be connected to a plurality of indoor units 200 to satisfy heating and cooling capacity demand in a corresponding installation space.

For example, as illustrated in FIG. 1, an indoor unit 1 200*a*, an indoor unit 2 200*b*, and an indoor unit 3 200*c* may be connected to one outdoor unit 100. However, the number of indoor units is not limited to the number illustrated in FIG. 1. The indoor units 200 that may be arranged in respective installation spaces may perform centralized control on an operation of each of the indoor units 200 in one place via a central controller even if a user does not approach the indoor unit 200 and may simultaneously perform individual control via the wired remote controller 300 connected to the indoor units 200.

In this case, the indoor units 200 and the wired remote controller 300 may be connected to each other via DC power two-wire communication in which communication signals may be linked to a power-supply line and the communication signals and power may be transmitted via 2 lines. That is, the indoor unit 200 may have a physical channel for communication using a separate method such as RS485 for communication with the outdoor unit 100 in addition to the DC power two-wire communication with the wired remote controller 300.

In addition, the indoor unit 200 may include a first communication module 210, a power switch 220, a ground switch 230, an indoor unit controller 240, and a second communication module 250.

The first communication module 210 may be a device for communication with the wired remote controller 300. In this case, the first communication module 210 and the wired remote controller 300 may be connected to each other using a method of sharing communication information using DC power two-wire communication.

Figure 2:
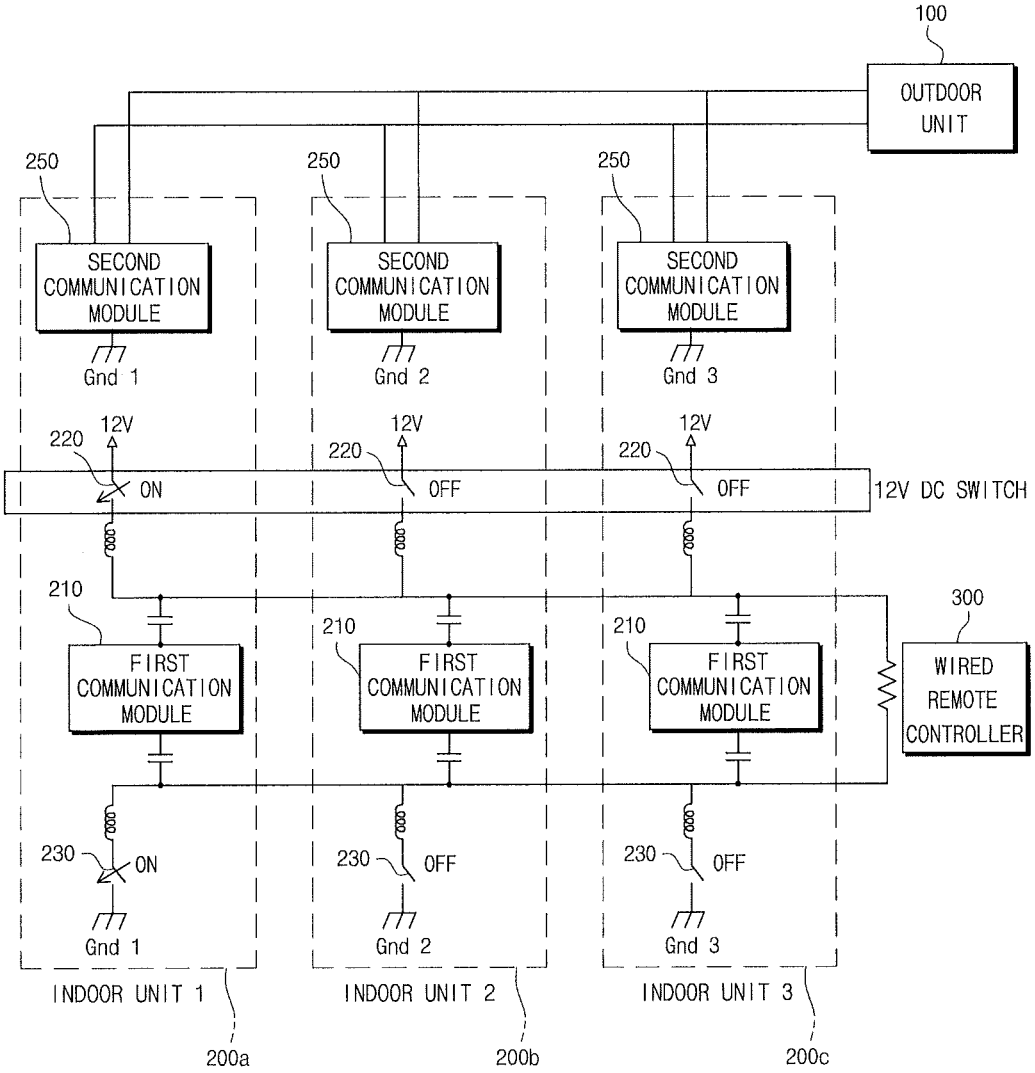
FIG. 2 is a circuit diagram of an air conditioning system according to one or more embodiments in which plural indoor units and a wired remote controller are connected in a straight polarity manner.
Figure 3:
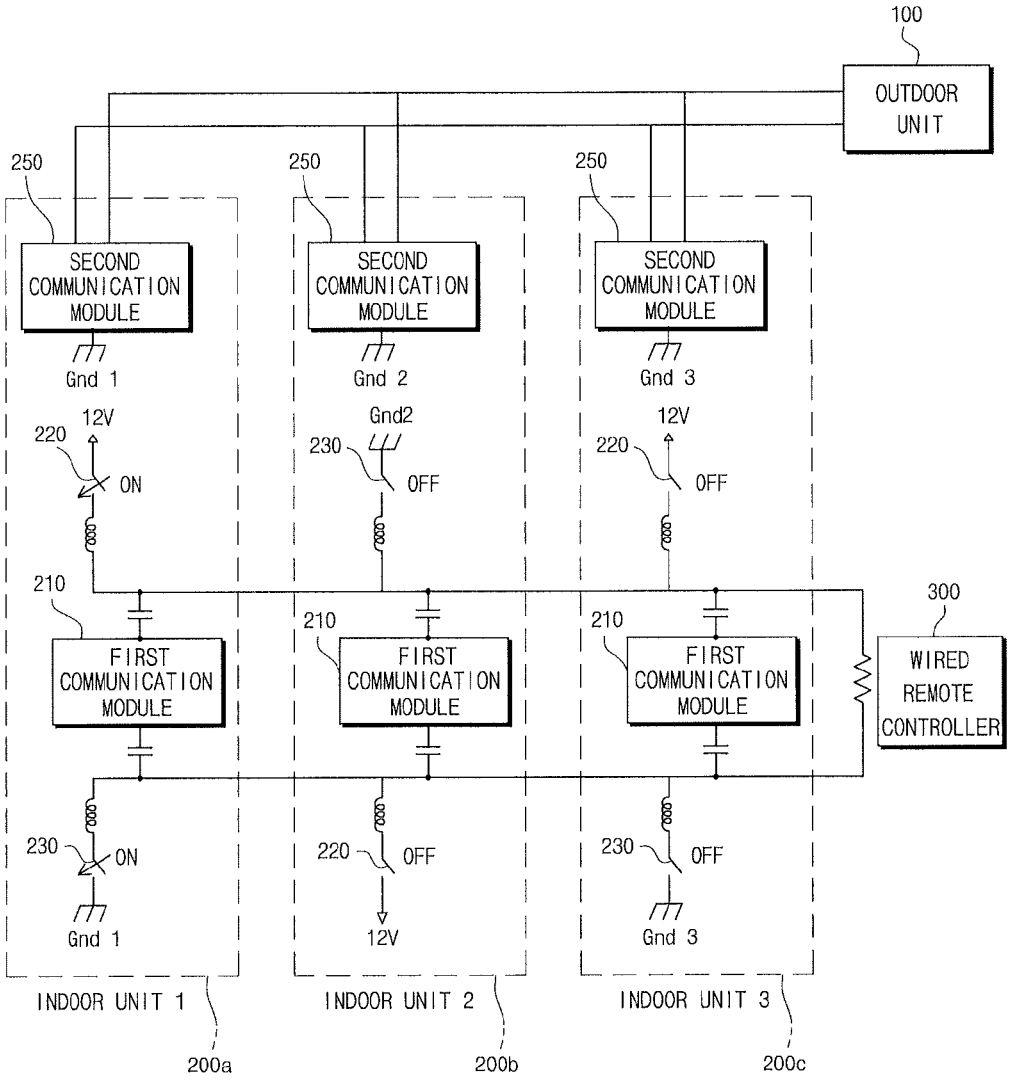
FIG. 3 is a circuit diagram of an air conditioning system according to one or more embodiments in which plural indoor units and a wired remote controller are connected in a reverse polarity manner.

As illustrated in FIGS. 2 and 3, the power switch 220 may be connected to a power terminal of one side or the other side of the first communication module 210.

As illustrated in FIGS. 2 and 3, the ground switch 230 may be connected to a ground terminal of one side or the other side of the first communication module 210 and may constitute a pair with the power switch 220.

The power switch 220 and the ground switch 230 may each include, but are not limited to, a relay or a transistor.

When an indoor unit supplies power to the wired remote controller 300, the indoor unit controller 240 may turn on the power switch 220 and the ground switch 230. When another indoor unit supplies power to the wired remote controller 300, the indoor unit controller 240 may turn off a group of the power switch 220 and the ground switch 230. For example, when the indoor unit 1 200*a* supplies power to the wired remote controller 300, the power switch 220 and the ground switch 230 of each of the indoor unit 2 200*b* and the indoor unit 3 200*c* may be turned off such that redundant power is not supplied from the indoor unit 2 200*b* and the indoor unit 3 200*c*.

That is, the indoor units 200 may include a plurality of indoor units each of which may be connected to the outdoor unit 100. When a specific indoor unit among the indoor units 200 supplies power to the wired remote controller 300, a group of the power switch 220 and ground switch 230 of the corresponding specific indoor unit may be turned on and a group of the power switch 220 and ground switch 230 of another indoor unit may be turned off. In this case, the group of the power switch 220 and ground switch 230 refers to the power switch 220 and the ground switch 230 which are arranged in one indoor unit 200. For example, the power switch 220 and ground switch 230 included in the indoor unit 1 200*a* may constitute a group.

This may be applied to the power switch 220 and ground switch 230 included in each of the indoor unit 2 200*b* and the indoor unit 3 200*c* in the same way. Thus, since only one of the indoor units 200 may supply power to the wired remote controller 300, a circuit malfunction may be prevented.

The wired remote controller 300 may receive power from the indoor unit 200 and operate. In addition, the wired remote controller 300 may transmit and receive information that is input and set by a user through the first communication module 210 of the indoor unit 200.

The wired remote controller 300 and the indoor unit 200 may communicate with each other in a straight polarity manner in which the wired remote controller 300 and the indoor unit 200 are connected to the same polarity, a reverse polarity manner in which the wired remote controller 300 and the indoor unit 200 are connected to different polarities, or a mixture thereof.

The second communication module 250 may be a component for communication with the outdoor unit 100. In addition, the second communication module 250 and the outdoor unit 100 may be connected via RS 485 two-wire communication, but embodiments of the present invention are not limited thereto.

FIG. 2 is a circuit diagram of an air conditioning system according to one or more embodiments in which the plural indoor units 200 and the wired remote controller 300 are connected in a straight polarity manner.

As illustrated in FIG. 2, the indoor units 200 including the indoor unit 1 200*a*, an indoor unit 2 200*b*, and the indoor unit 3 200*c* may be connected to one outdoor unit 100 through the second communication module 250 included in each of the indoor unit 1 200*a*, an indoor unit 2 200*b*, and the indoor unit 3 200*c*.

In addition, the power switch 220 may be connected to the first communication module 210 and may be formed between the first communication module 210 and a power terminal (for example, 12 V of FIG. 2) so as to turn on or off connection between the power terminal and the first communication module 210. In this case, the power terminal may supply 12 V direct current (DC) power.

The ground switch 230 may be connected to the first communication module 210 and may be formed between the first communication module 210 and a ground terminal (for example, Gnd1, Gnd2, or Gnd3 of FIG. 2) so as to turn on or off connection between the ground terminal and the first communication module 210.

As illustrated in FIG. 2, all the power terminals of the indoor unit 1 200*a* to the indoor unit 3 200*c* may be formed at one side of the first communication module 210 and all the ground terminals of the indoor unit 1 200*a* to the indoor unit 3 200*c* may be formed at the other side of the first communication module 210 to form straight polarity in the indoor unit 1 200*a* through the indoor unit 3 200*c*. In this case, as power is supplied to the wired remote controller 300 by closing the group of the power switch 220 and ground switch 230 included in the indoor unit 1 200*a* such that the power switch 220 and ground switch 230 are turned on in terms of circuit configuration, the group of the power switch 220 and ground switch 230 included in each of the indoor unit 2 200*b* and the indoor unit 3 200*c* may be opened such that the power switch 220 and the ground switch 230 may be turned off in terms of circuit configuration.

In addition, as illustrated in FIG. 2, an inductor to induce a voltage in proportion to variation in current to prevent sharp change of current, and a capacitor for static capacity may be arranged between the power switch 220 and the first communication module 210, but embodiments of the present invention are not limited thereto. That is, another element may be arranged between the power switch 220 and the first communication module 210 according to operator intention. For example, as illustrated in FIG. 2, the inductor may be connected to the power switch 220 and the capacitor may be connected to a side of the first communication module 210.

An inductor and a capacitor may also be arranged between the ground switch 230 and the first communication module 210, but embodiments of the present invention are not limited thereto. For example, as illustrated in FIG. 2, the inductor may be connected to the ground switch 230 and the capacitor may be connected to a side of the first communication module 210.

FIG. 3 is a circuit diagram of an air conditioning system according to one or more embodiments in which the plural indoor units 200 and the wired remote controller 300 are connected in a reverse polarity manner.

As illustrated in FIG. 3, the indoor units 200 including the indoor unit 1 200*a*, an indoor unit 2 200*b*, and the indoor unit 3 200*c* may be connected to one outdoor unit 100 through the second communication module 250 included in each of the indoor unit 1 200*a*, an indoor unit 2 200*b*, and the indoor unit 3 200*c*.

In addition, the power switch 220 may be connected to the first communication module 210 and may be formed between the first communication module 210 and a power terminal (for example, 12 V of FIG. 3) so as to turn on or off connection between the power terminal and the first communication module 210. In this case, the power terminal may supply 12 V direction current (DC) power.

The ground switch 230 may be connected to the first communication module 210 and may be formed between the first communication module 210 and a ground terminal (for example, Gnd1, Gnd2, or Gnd3 of FIG. 3) so as to turn on or off connection between the ground terminal and the first communication module 210.

As illustrated in FIG. 3, the power terminal of each of the indoor unit 1 200*a* and the indoor unit 3 200*c* may be formed at one side of the first communication module 210 and the power terminal of the indoor unit 2 200*b* may be formed at the other side of the first communication module 210, and the ground terminal of each of the indoor unit 1 200*a* and the indoor unit 3 200*c* may be formed at the other side of the first communication module 210 and the ground terminal of the indoor unit 2 200*b* may be formed at one side of the first communication module 210, thereby forming reverse polarity.

In this circuit structure, as power is supplied to the wired remote controller 300 by closing the group of the power switch 220 and ground switch 230 included in the indoor unit 1 200*a* such that the power switch 220 and ground switch 230 are turned on in terms of circuit configuration, the group of the power switch 220 and ground switch 230 included in each of the indoor unit 2 200*b* and the indoor unit 3 200*c* may be opened such that the power switch 220 and the ground switch 230 may be turned off in terms of circuit configuration. Thus, even if reverse polarity is formed between components, a ground level between the indoor unit 1 200*a*, the indoor unit 2 200*b*, and the indoor unit 3 200*c* may be kept constant, thereby possibly preventing circuit malfunction.

In addition, as illustrated in FIG. 3, an inductor to induce a voltage in proportion to variation in current to prevent sharp change of current, and a capacitor for static capacity may be arranged between the power switch 220 and the first communication module 210, but embodiments of the present invention are not limited thereto. That is, another element may be arranged between the power switch 220 and the first communication module 210 according to operator intention. For example, as illustrated in FIG. 3, the inductor may be connected to the power switch 220 and the capacitor may be connected to a side of the first communication module 210.

An inductor and a capacitor may also be arranged between the ground switch 230 and the first communication module 210, but embodiments of the present invention are not limited thereto. For example, as illustrated in FIG. 3, the inductor may be connected to the ground switch 230 and the capacitor may be connected to a side of the first communication module 210.

Figure 4:
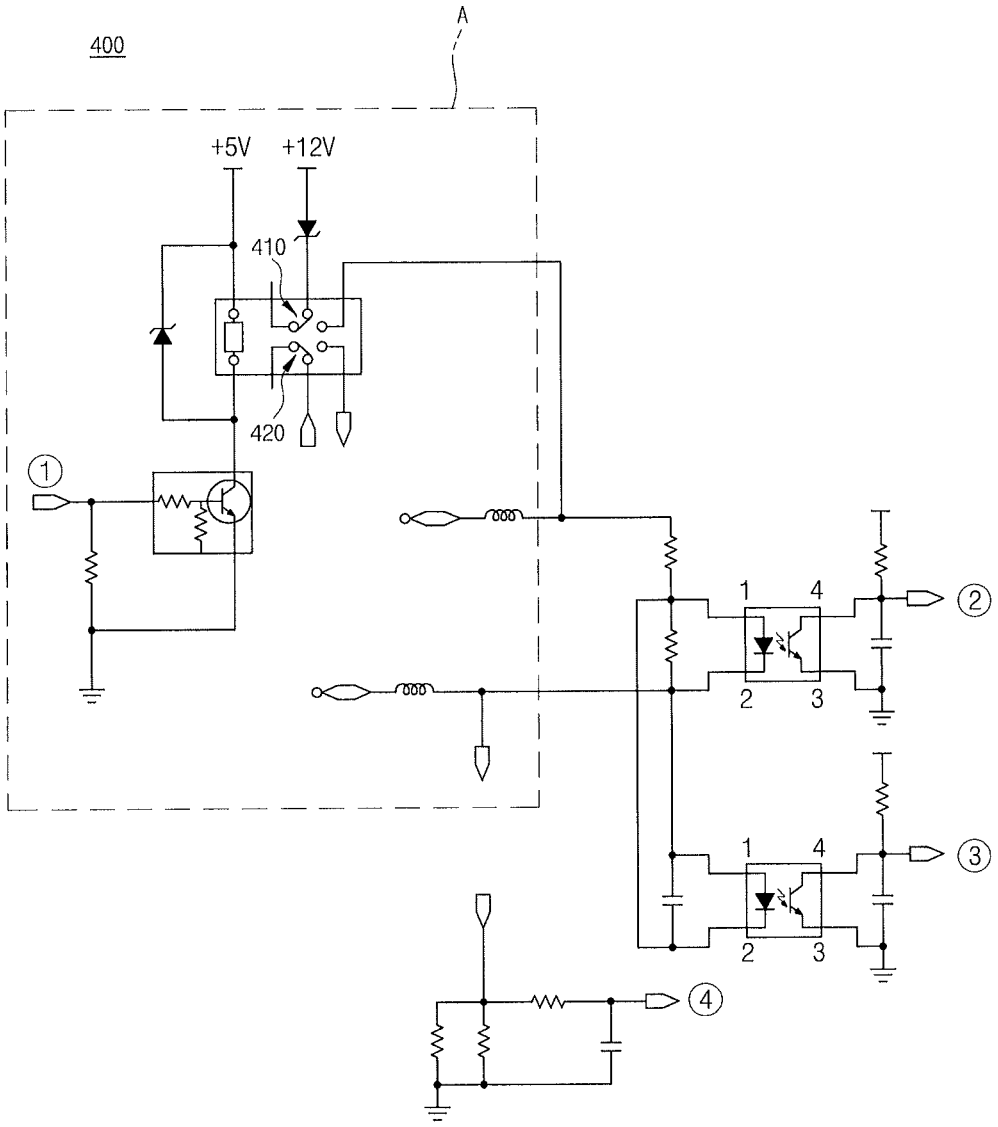
FIGS. 4 and 5 are circuit diagrams illustrating indoor units of an air conditioning system according to one or more embodiments in more detail.
Figure 5:
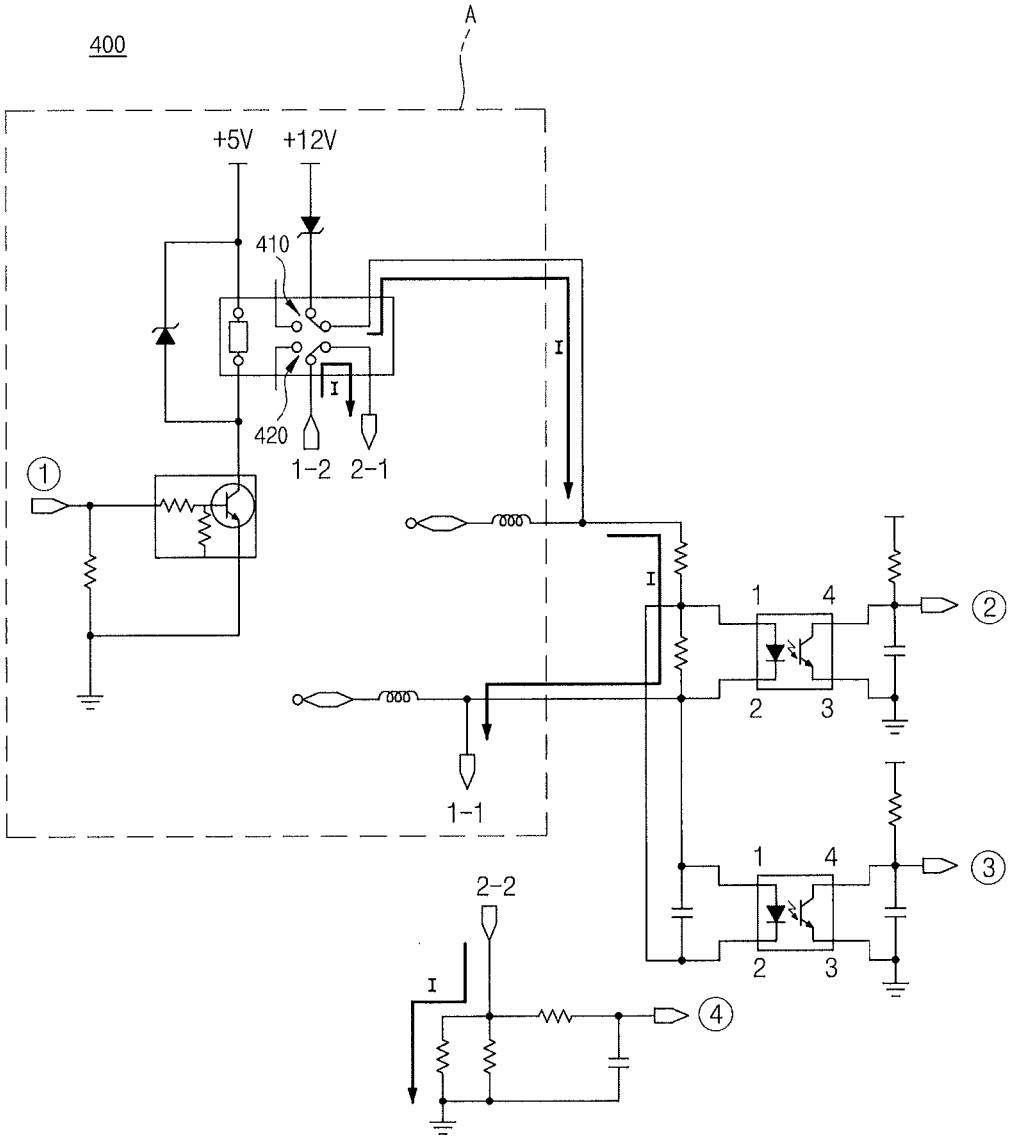

FIGS. 4 and 5 are circuit diagrams illustrating indoor units of an air conditioning system according to one or more embodiments, such as the indoor units 200 in more detail.

As illustrated in FIG. 4, a terminal ①, a terminal ②, a terminal ③, and a terminal ④ may be connected to a microcomputer (MICOM) corresponding to an indoor unit controller. The terminal ① may receive a power-supply signal, the terminal ② may check for overcurrent, and the terminals ③ and ④ may check the power-supply signal.

In addition, in the circuit of FIG. 4, a region A may refer to a C junction relay to open or close DC power and ground. As a power switch 410 and a ground switch 420 are closed so as to be turned on in terms of circuit configuration (FIG. 4->FIG. 5), an applied power signal may be transmitted along a path I of FIG. 5.

Referring to FIG. 5, as the power switch 410 and the ground switch 420 are turned on, a signal transmitted along the path I may reach a ground terminal through a terminal 1-1→a terminal 1-2→a terminal 2-1→terminal 2-2. This corresponds to a description of an operating state of the indoor unit 200 including a power switch and a ground switch which are turned on, among the plural indoor units 200 illustrated in FIGS. 1 through 3.

In this regard, a group of a power switch and ground switch of another indoor unit, which are not closed, may be opened such that the power switch and the ground switch may remain off.

In general, a communication module for communication between an indoor unit and an outdoor unit may have a common mode range (CMR) that is limitation in potential difference between ground terminals of the indoor and outdoor units. When the potential difference between the ground terminals exceeds the CMR, communication error may occur. According to one or more embodiments, a ground switch connected to a ground terminal of an indoor unit and a power switch connected to a power terminal of the indoor unit may be used. Thus, when a specific indoor unit among a plurality of indoor units supplies power to a wired remote controller, a power switch and ground switch of another indoor unit may be opened to be turned off in terms of circuit configuration, and thus, a ground level may be maintained even if the indoor units and the wired remote controller are connected in a straight polarity manner, a reverse polarity manner, or a mixture thereof.

As is apparent from the above description, an indoor unit and an air conditioning system using the same according to one or more embodiments may maintain a stable ground level regardless of polarities connected between an indoor unit and a wired remote controller by applying a power switch and a ground switch to the indoor unit.

While aspects of the present invention have been particularly shown and described with reference to differing embodiments thereof, it should be understood that these embodiments should be considered in a descriptive sense only and not for purposes of limitation. Descriptions of features or aspects within each embodiment should typically be considered as available for other similar features or aspects in the remaining embodiments. Suitable results may equally be achieved if the described techniques are performed in a different order and/or if components in a described system, architecture, device, or circuit are combined in a different manner and/or replaced or supplemented by other components or their equivalents.

Thus, although a few embodiments have been shown and described, with additional embodiments being equally available, it would be appreciated by those skilled in the art that changes may be made in these embodiments without departing from the principles and spirit of the invention, the scope of which is defined in the claims and their equivalents.

What is claimed is:

1. An indoor unit for an air conditioning system comprising:

a first communication module to communicate with a wired remote controller;

a power switch connected to a power terminal of a first side or a second side of the first communication module;

a ground switch connected to a ground terminal of the first side or the second side of the first communication module to constitute a pair with the power switch; and an indoor unit controller to turn on the power switch and the ground switch when an indoor unit supplies power to the wired remote controller, and to turn off the power switch and the ground switch when another indoor unit supplies power to the wired remote controller.

2. The indoor unit according to claim 1, wherein the wired remote controller and the indoor unit communicate with each other in a straight polarity manner of connecting the wired remote controller and the indoor unit to the same polarity, a reverse polarity manner of connecting the wired remote controller and the indoor unit to different polarities, or a mixture thereof.

3. The indoor unit according to claim 1, wherein the power switch and the ground switch each comprise a relay or a transistor.

4. The indoor unit according to claim 1, wherein the wired remote controller and the first communication module are connected to each other using DC power two-wire communication to transmit a communication signal and power via two lines.

5. The indoor unit according to claim 1, further comprising a second communication module to communicate with an outdoor unit.

6. The indoor unit according to claim 5, wherein the outdoor unit and the second communication module are connected using RS485 two-wire communication.

7. An air conditioning system comprising:

an outdoor unit;

a wired remote controller to receive power from an indoor unit; and a plurality of indoor units connected to the outdoor unit, wherein a power switch and a ground switch of one indoor unit among the plurality of indoor units are turned on and a power switch and a ground switch of each remaining indoor unit among the plurality of indoor units are turned off when the one indoor unit supplies power to the wired remote controller.

8. The air conditioning system according to claim 7, wherein the indoor unit comprises:

a first communication module to communicate with the wired remote controller;

a power switch connected to a power terminal of a first side or a second side of the first communication module;

a ground switch connected to a ground terminal of the first side or the second side of the first communication module to constitute a pair with the power switch; and an indoor unit controller to turn on the power switch and the ground switch when an indoor unit supplies power to the wired remote controller, and to turn off the power switch and the ground switch when another indoor unit supplies power to the wired remote controller.

9. The air conditioning system according to claim 8, wherein the power switch and the ground switch each comprise a relay or a transistor.

10. The air conditioning system according to claim 8, wherein the wired remote controller and the first communication module are connected to each other using DC power two-wire communication to transmit a communication signal and power via two lines.

11. The air conditioning system according to claim 8, each indoor unit further comprising a second communication module to communicate with the outdoor unit.

12. The air conditioning system according to claim 11, wherein the outdoor unit and the second communication module are connected using RS485 two-wire communication.

13. The air conditioning system according to claim 7, wherein the wired remote controller and the indoor unit communicate with each other in a straight polarity manner of connecting the wired remote controller and the indoor unit to the same polarity, a reverse polarity manner of connecting the wired remote controller and the indoor unit to different polarities, or a mixture thereof.

14. An air conditioning system comprising:

a wired remote controller to receive power from an indoor unit; and a plurality of indoor units connected to the wired remote controller, wherein a power switch and a ground switch of one indoor unit among the plurality of indoor units are turned on and a power switch and a ground switch of each remaining indoor unit among the plurality of indoor units are turned off when the one indoor unit supplies power to the wired remote controller.

15. The air conditioning system according to claim 14, wherein the indoor unit comprises:

a first communication module to communicate with a wired remote controller;

a power switch connected to a power terminal of a first side or a second side of the first communication module;

a ground switch connected to a ground terminal of a first side or a second side of the first communication module to constitute a pair with the power switch; and an indoor unit controller to turn on the power switch and the ground switch when an indoor unit supplies power to the wired remote controller, and to turn off the power switch and the ground switch when another indoor unit supplies power to the wired remote controller.

16. The air conditioning system according to claim 15, wherein the power switch and the ground switch each comprise a relay or a transistor.

17. The air conditioning system according to claim 15, wherein the wired remote controller and the first communication module are connected to each other using DC power two-wire communication to transmit a communication signal and power via two lines.

18. The air conditioning system according to claim 15, each indoor unit further comprising a second communication module to communicate with an outdoor unit.

19. The air conditioning system according to claim 18, wherein the outdoor unit and the second communication module are connected using RS485 two-wire communication.

20. The air conditioning system according to claim 14, wherein the wired remote controller and the indoor unit communicate with each other in a straight polarity manner of connecting the wired remote controller and the indoor unit to the same polarity, a reverse polarity manner of connecting the wired remote controller and the indoor unit to different polarities, or a mixture thereof.

* * * * *